US006325504B1

(12) United States Patent
Tomii et al.

(10) Patent No.: US 6,325,504 B1
(45) Date of Patent: Dec. 4, 2001

(54) INK-JET PRINTER FOR PREVENTING CONTACT BETWEEN A SHEET AND IN INK-JET HEAD

(75) Inventors: Tsuyoshi Tomii; Susumu Murayama, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/065,613

(22) Filed: Apr. 24, 1998

(30) Foreign Application Priority Data

Apr. 24, 1997 (JP) ..... 9-121690

(51) Int. Cl.[7] ..... B41J 2/01
(52) U.S. Cl. ..... 347/104
(58) Field of Search ..... 347/55, 104, 86, 347/106, 108, 101, 151, 120, 141, 154, 123, 103, 111, 159, 127, 128, 131, 125, 158; 271/188; 399/271, 290, 292, 294, 295

(56) References Cited

U.S. PATENT DOCUMENTS 5,393,151 2/1995 Martin et al. ..... 400/642
5,815,186 * 9/1998 Lewis et al. ..... 347/104
5,874,979 * 2/1999 Ohyama ..... 347/104

FOREIGN PATENT DOCUMENTS 0 622 227 11/1994 (EP) ..... B41J/13/10

OTHER PUBLICATIONS

Patent Abstracts Of Japan, vol. 097, No. 012, Dec. 25, 1997 & JP 09 220837 A (Canon Inc), Aug. 26, 1997 *Abstract.

* cited by examiner

*Primary Examiner*—Raquel Yvette Gordon
(74) *Attorney, Agent, or Firm*—Sughrue, Mion, Zinn, Macpeak & Seas, PLLC

(57) ABSTRACT

A supporting part 11 arranged nearer to a head 1 than a pair of carrier rollers 3 and on the same side as a rib 2*a* based upon paper S for supporting the side Sb of the paper S toward the head 1 is provided. The supporting part 11 is formed so that it is wider than the rib 2*a*. The driving roller 3*a*1 of the pair of carrier rollers and the supporting part 11 are overlapped when they are viewed from a direction in which paper is carried. A ringed member 4 may be also provided in place of overlapping the supporting part 11 and the driving roller 3*a*1.

7 Claims, 3 Drawing Sheets

INK-JET PRINTER FOR PREVENTING CONTACT BETWEEN A SHEET AND IN INK-JET HEAD

BACKGROUND OF THE INVENTION

1. Field of the Invention

The present invention relates to an ink-jet printer. Particularly, the present invention relates to technique for preventing paper and a head from being rubbed.

2. Related Art

FIG. 3 (*a*) is a partial plan showing an example of a conventional type ink-jet printer and FIG. 3 (*b*) is a partial front view.

As shown in FIG. 3 (*a*) and FIG. 3 (*b*), S denotes paper and the paper S is intermittently carried by predetermined pitch (for example, space pitch) in a direction shown by an arrow Y by a paper feed roller not shown and others.

A reference number 1 denotes a head and the head 1 jets ink droplets, being moved in a direction shown by an arrow X1 or X2 when the carriage of the paper S is stopped and prints on the paper S.

A reference number 2 denotes an interval regulating member and the interval regulating member 2 is arranged on the side (on the lower side in FIG. 3(*b*)) reverse to the head 1 based upon the paper S. Plural ribs 2*a* for supporting the lower surface (the unprinted face) of the paper S are integrated with the upper surface of the interval regulating member 2 and as these ribs 2*a* support the lower surface of the paper S, an interval between the paper S and the head 1 is regulated.

A reference number 3 denotes a pair of carrier rollers and the pair of carrier rollers 3 carry the paper S printed by the head 1. The pair of carrier rollers 3 are energized by a driving roller 3*a* and means for suitably energizing the driving roller 3*a* so that the pair of carrier rollers 3 can be rotated and provided with an indented roller (a thin star wheel) 3*b* rotated according to the driving roller 3*a*.

The pair of carrier rollers 3 carry paper S, pressing it between the driving roller 3*a* and the indented roller 3*b* and its narrow pressing part 3*c* is set so that the height for the head 1 is lower than the height of the rib 2*a* when they are viewed from a direction in which paper is carried as shown in FIG. 3 (*b*) so as to press the paper S upon the rib 2*a*.

According to such an ink-jet printer, even if paper S is a little extended because of the moisture of an ink droplet jetted on the paper S by the head 1, the extended quantity is often located between the ribs 2*a* as shown in FIG. 3 (*b*). Therefore, a situation in which the paper S and the head 1 are rubbed due to the paper S being raised on the side of the head 1 is prevented to some extent.

However, in the above conventional type ink-jet printer, when the end Sa of paper S reaches the pair of carrier rollers 3 and the paper S is carried by the pair of carrier rollers 3, the side Sb of the paper S is pressed down as shown in FIG. 3 (*c*) because the narrow pressing part 3*c* of the pair of carrier rollers 3 is set so that the height for the head 1 is lower than the height of the rib 2*a* and as a result, a part Sc adjacent to the side Sb is raised on the side of the head 1 and the lower surface of the head 1 may be rubbed upon the raised part Sc. In such a case, the printed face of the paper S is contaminated.

SUMMARY OF THE INVENTION

The object of the present invention is to provide an ink-jet printer which can solve the above problem and prevent paper and its head from being rubbed.

To achieve the above object, an ink-jet printer is provided with a head for jetting and printing ink droplets upon paper, plural ribs arranged opposite to the head for supporting the unprinted face of paper, a pair of carrier rollers for carrying the paper printed by the head and a supporting part arranged nearer to the head in the vertical direction than the pair of carrier rollers and on the same side as the ribs for supporting the side of the paper toward the head.

The ink-jet printer of the present invention includes a supporting part formed so that it is wider than the above rib.

In the ink-jet of the present invention, a part of the above pair of carrier rollers and the above supporting part are overlapped when they are viewed from a direction in which the paper is carried.

The ink-jet printer of the present invention includes a ringed member for supporting the side of paper toward the above head provided to the shaft of the above pair of carrier rollers in a position in which a part of the pair of carrier rollers is overlapped with the above supporting part when they are viewed from a direction in which paper is carried.

According to the ink-jet printer of the present invention, ink droplets are jetted and printed upon paper by the head and in a state in which the unprinted face of paper is supported by plural ribs and the printed paper is carried by the pair of carrier rollers. Even if paper is a little extended because of the moisture of an ink droplet jetted upon the paper by the head, a situation in which the paper raised on the side of the head and the head are rubbed is prevented to some extent because the extended quantity is often located between the ribs.

Further, according to the ink-jet printer of the present invention, because the supporting part arranged nearer to the head than the pair of carrier rollers and on the same side as the ribs for supporting the side of paper facing toward the head is provided, the side of the paper is supported by the supporting part and is prevented from being pressed down.

Therefore, the quantity raised on the side of the head of a part adjacent to the side is also reduced and as a result, a situation in which the lower surface of the head and the paper are rubbed is prevented.

According to the ink-jet printer of the present invention, because the above supporting part is formed so that it is wider than the above rib, the side of paper is securely supported and as a result, a situation in which the lower surface of the head and the paper are rubbed is securely prevented.

According to the ink-jet printer of the present invention, a part of the pair of carrier rollers and the supporting part are overlapped when they are viewed from a direction in which paper is carried, the displacement of the side of paper (for example, the amount the paper is being pressed down) on the side of the pair of carrier rollers is also inhibited. Therefore, the quantity raised on the side of the head of a part adjacent to the side is also more securely reduced and as a result, a situation in which the lower surface of the head and the paper are rubbed is more securely prevented.

According to the ink-jet of the present invention, the ringed member for supporting the side of paper toward the head is provided to the shaft of the above pair of carrier rollers in a position in which a part of the pair of carrier rollers is overlapped with the above supporting part when they are viewed from a direction in which paper is carried, the displacement of the side of paper (for example, the amount the paper is being pressed down) on the side of the pair of carrier rollers is inhibited by the ringed member and therefore, the quantity raised on the side of the head of a part adjacent to the side is also more securely reduced.

As a result, a situation in which the lower surface of the head and the paper are rubbed is more securely prevented.

DETAILED DESCRIPTION OF THE PREFERRED EMBODIMENTS

Figure 1:
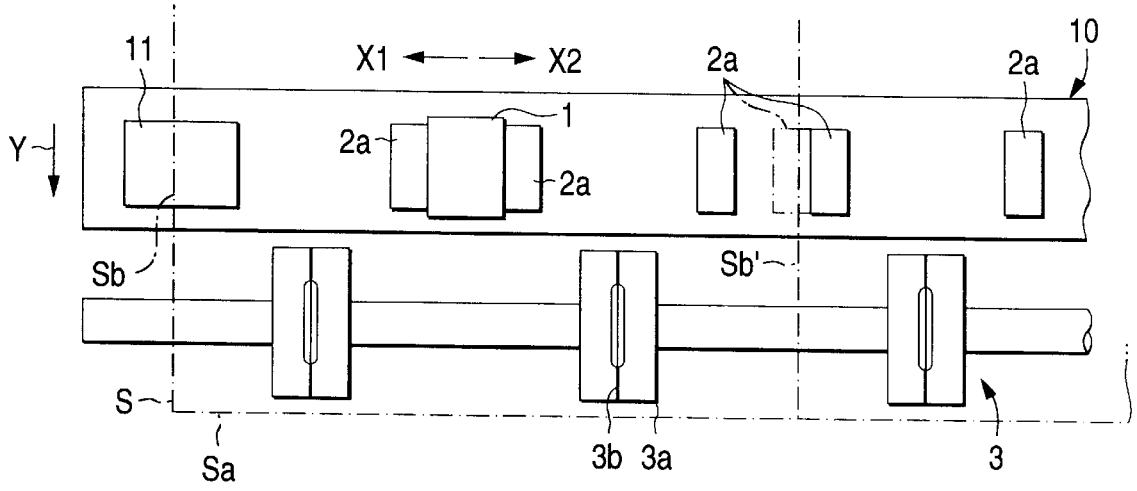
FIGS. 1 (*a*) and 1 (*b*) show a first embodiment of an ink-jet printer according to the present invention, FIG. 1 (*a*) is a partial plan and FIG. 1 (*b*) is a partial front view.
Figure 1:
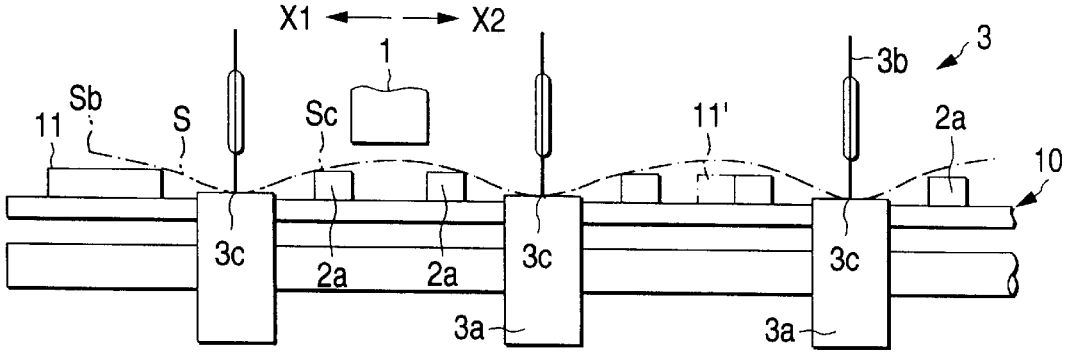

Referring to the drawings, embodiments of the present invention will be described below.

<First Embodiment>

FIGS. 1 (*a*) and 1 (*b*) show a first embodiment of an ink-jet printer according to the present invention, FIG. 1 (*a*) is a partial plan and FIG. 1 (*b*) is a partial front view. The same reference numbers are allocated to the same part in these drawings as in the conventional type shown in FIG. 3 (*a*) and 3 (*c*) and the description is omitted.

This embodiment is characterized in that a supporting part 11 is provided. The supporting part 11 is arranged nearer to a head 1 than a pair of carrier rollers 3 (on the upper side in FIG. 1 (*a*)) and on the same side as a rib 2*a* facing paper S (that is, on the side facing the unprinted face) and supports the side Sb of the paper S so that it extends toward the head 1 as shown in FIG. 1 (*b*). The supporting part 11 is integrated with the upper surface of an interval regulating member 10 as is the rib 2*a*. The supporting part 11 is formed so that the width (the length in a direction shown by an arrow X1 or X2) is wider than the width of the rib 2*a* and so that the height from the head 1 is approximately the same as that from the head 1 to the rib 2*a*.

According to such an ink-jet printer, ink droplets are jetted by the head 1 and printed upon paper S in a state in which the unprinted face of the paper S is supported by the plural ribs 2*a* and the printed paper S is carried by the pair of carrier rollers 3. Even if the paper S is a little extended because of the moisture of an ink droplet jetted upon the paper S by the head 1, a situation in which the paper S raised on the side of the head 1 and the head 1 are rubbed is prevented to some extent because the extended quantity is often located between the ribs as shown in FIG. 3 (*b*).

Figure 3:
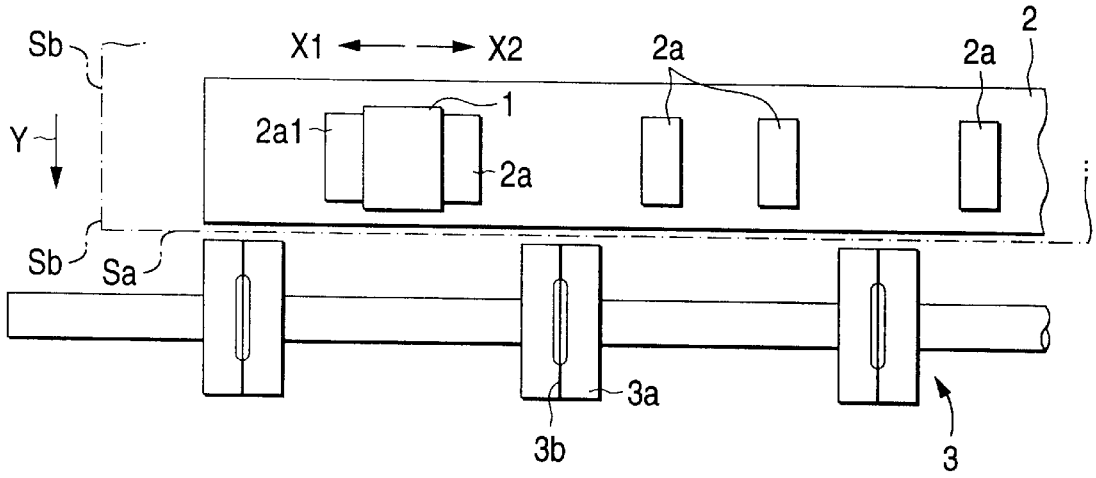
FIGS. 3 (*a*)–3 (*c*) show an example of a conventional type ink-jet printer, FIG. 3 (*a*) is a partial plan, FIGS. 3 (*b*) and 3 (*c*) are respectively partial front views.
Figure 3:
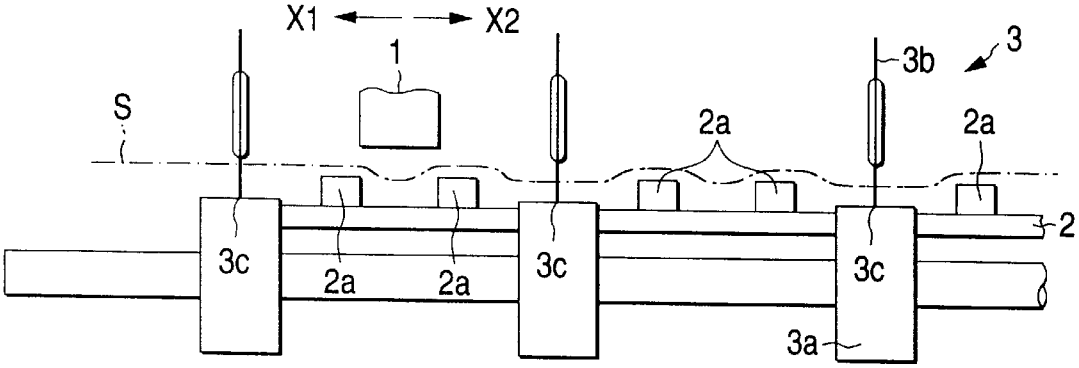
Figure 3:
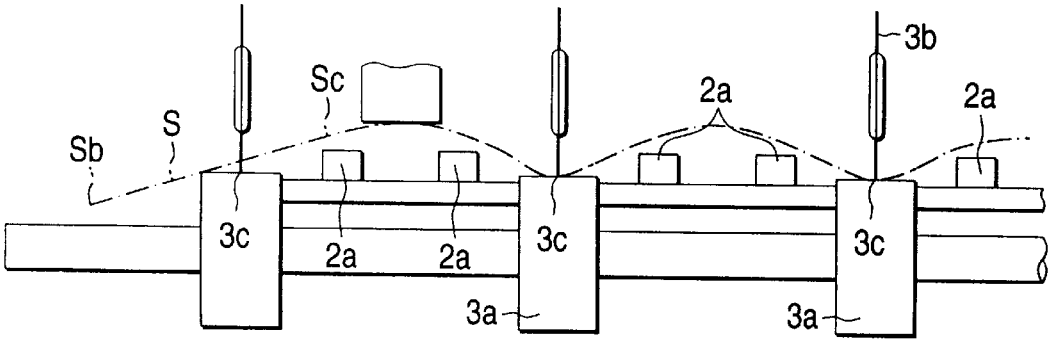

Further, according to the ink-jet printer equivalent to this embodiment, because the supporting part 11 is arranged nearer to the head 1 in the vertical direction than the pair of carrier rollers 3 and on the same side as the rib 2*a*, the side Sb of the paper S is supported by the supporting part 11 as shown in FIG. 1 (*b*) and is prevented from being pressed down as shown in FIG. 3 (*c*).

Therefore, the amount of deflection towards the head 1 of a part Sc adjacent to the side Sb is also reduced as shown in FIG. 1 (*b*). As a result, a situation in which the lower surface of the head 1 and the paper S are rubbed is prevented.

Because the supporting part 11 is formed so that it is wider than the rib 2*a,* the side Sb of paper S is securely supported and as a result, a situation in which the lower surface of the head 1 and the paper S are rubbed is securely prevented.

The supporting part 11 may be also provided in a position in which the side of a paper S relatively small in size is supported. A supporting part shown by an alternate long and short dash line 11' in FIGS. 1 (*a*) and 1 (*b*) is provided for paper small in size and an alternate long and two short dashed line Sb' shows the side of the paper small in size.

<Second Embodiment>

Figure 2:
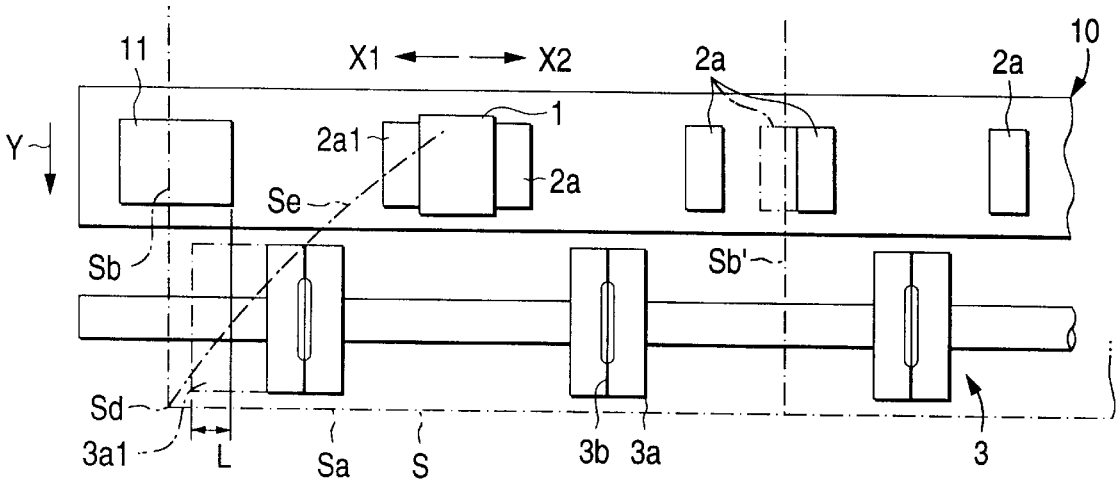
FIGS. 2 (*a*) and 2 (*b*) show a second embodiment of an ink-jet printer according to the present invention, FIG. 2 (*a*) is a partial plan, FIG. 2 (*b*) is a partial front view and FIG. 2 (*c*) is a partial front view showing a third embodiment of an ink-jet printer according to the present invention.
Figure 2:
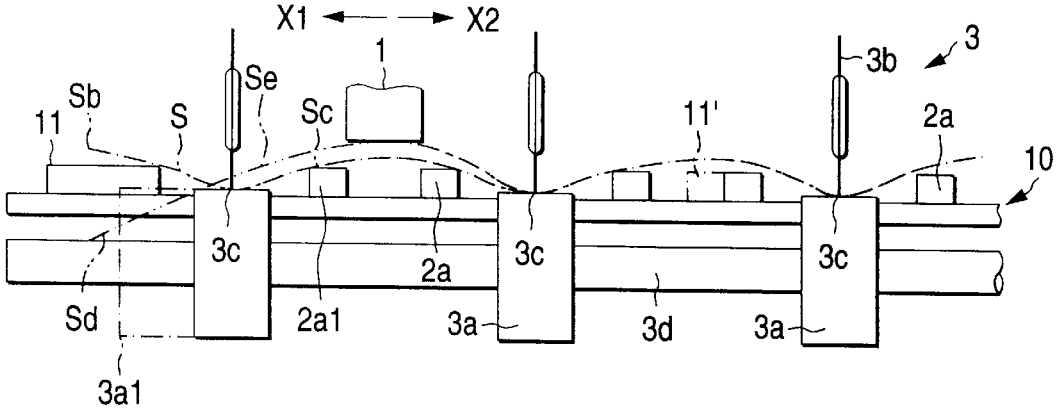
Figure 2:
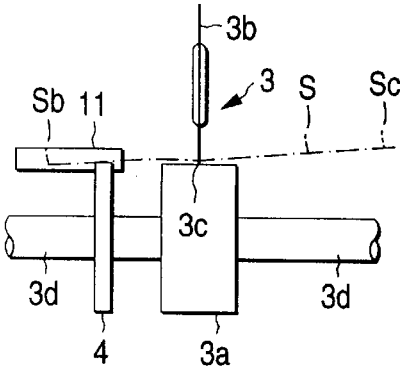

FIGS. 2 (*a*) and 2 (*b*) show a second embodiment of an ink-jet printer according to the present invention, FIG. 2 (*a*) is a partial plan and FIG. 2 (*b*) is a partial front view. In these drawings, the same reference numbers are allocated to the same parts as in the first embodiment shown in FIGS. 1 (*a*) and 1 (*b*) and the description is omitted.

The second embodiment is different from the above first embodiment in that a part of a pair of carrier rollers 3 and a supporting part 11 are overlapped when they are viewed from a direction in which paper is carried as shown in FIG. 2 (*b*) and is the same as the first embodiment in other points. In this embodiment, a part of the pair of carrier rollers is partly overlapped with the supporting part 11 by shifting a driving roller 3*a*1 at the end as shown by an alternate end as shown by an alternate long and two short dashed line or constituting the driving roller so that it is longer. 'L' in FIG. 2 (*a*) shows the overlapped quantity.

Such construction is provided for the following reason:

That is, in the above first embodiment shown in FIGS. 1 (*a*) and 1 (*b*), because there is no overlap between a part of the pair of carrier rollers and the supporting part, the corner Sd of paper S may be pressed down or may hang (in a direction far from a head 1 (may be displaced downward in FIG. 2 (*b*)) as shown by an alternate long and two short dashes line Sd in FIG. 2 (*b*) when the end Sa of the paper S reaches the pair of carrier rollers 3 or a small part of the paper S passes the carrier rollers even if the side Sb of the paper S is supported by the supporting part 11. In such a state, a rigid convex portion Se from the corner Sd of the paper S toward a rib 2*a*1 at the end as shown by an alternate long and short dash line Se in FIG. 2 (*a*) is formed and, the paper S and the head 2 may be rubbed.

In the meantime, according to the second embodiment, because a part of the pair of carrier rollers and the supporting part 11 are overlapped when they are viewed from a direction in which paper is carried as shown in FIG. 2 (*b*), the above displacement (for example, being pressed down) of the side of paper, particularly the corner Sd on the side of the pair of carrier rollers 3 is inhibited and therefore, the formation of the above rigid convex portion Se is also inhibited. As a result, the amount of deflection of the papers opposite the head 1 of a part Sc adjacent to the side Sb is also more securely reduced and a situation in which the lower surface f the head 1 and the paper S are rubbed is more securely prevented.

When the paper S is small in size a driving roller 3*a* of the pair of carrier rollers can be overlapped with a supporting part 11' (see FIG. 2 (*b*).

<Third Embodiment>

FIG. 2 (*c*) is a partial front view showing a third embodiment of an ink-jet printer according to the present invention. In FIG. 2 (*c*), the same reference numbers are allocated to the same parts as in the second embodiment shown in FIGS. 2 (*a*) and 2 (*b*) and the description is omitted.

The third embodiment is different from the above second embodiment in that a ringed member 4 for supporting the side Sb the paper S so that it extends toward the head 1 is provided on the shaft 3*d* supporting the pair of carrier rollers 3 in a position in which the ringed member 4 is overlapped with the supporting part 11 when they are viewed from a direction in which paper is carried as shown in FIG. 2 (*c*).

That is, in the second embodiment, a part of the pair of carrier rollers 3 and the supporting part 11 are overlapped, while in the third embodiment, the ringed member 4 is provided in a position in which the ringed member is overlapped with the supporting 11 in place of overlapping a part of the pair of carrier rollers 3 and the supporting part 11.

In such a construction the above displacement (for example, being pressed down) of the side of paper, particularly the corner Sd on the side of the pair of carrier rollers 3 is also inhibited and therefore, the information of the above rigid convex portion Se is also inhibited. As a result, the amount of deflection of the paper S opposite the head 1 of a part Sc adjacent to the side Sb is also more securely reduced and a situation in which the lower surface of the head 1 and the paper S are rubbed is more securely prevented.

When the paper S is small in size, the ringed member 4 may be also provided in a position in which the ringed member 4 is overlapped with a supporting part 11' as shown in FIG. 2 (*b*).

The embodiments of the present invention are described above, however, the present invention is not limited to the above embodiments and may be suitably varied within a range of the outline of the present invention.

According to any ink-jet printer of the present invention, a situation in which the lower surface of the head and paper are rubbed can be prevented.

Further, according to the ink-jet printer of the present invention, a situation in which the lower surface of the head and paper are rubbed can be more securely prevented.

According to the ink-jet printer of the present invention, a situation in which the lower surface of the head and paper are rubbed can be also more securely prevented.

What is claimed is:

1. An ink-jet printer comprising:

a head for jetting and printing ink droplets on paper;

a plurality of ribs arranged opposite to the head for supporting an unprinted face of said paper;

carrier rollers for carrying said paper printed by said head; and a supporting part arranged nearer said head than the carrier rollers in a direction transverse to a direction in which the paper is carried and toward said head, said supporting part facing said unprinted face of said paper for supporting the unprinted face of said paper so that a side of said paper extends toward said head.

2. A ink-jet printer according to claim 1, wherein said supporting part is formed so that said supporting part is wider than said rib in a direction parallel to said direction.

3. A ink-jet printer according to claim 2, wherein a part of said carrier rollers and said supporting part are overlapped when viewed from a direction in which said paper is carried.

4. An ink-jet printer according to claim 2, further comprising:

a ringed member for supporting the unprinted face of said paper so that a side of said paper extends toward said head which is provided on a shaft supporting said carrier rollers in a position such that a part of said carrier rollers is overlapped with said supporting part when viewed from a direction in which said paper is carried.

5. A ink-jet printer according to claim 1, wherein a part of said carrier rollers and said supporting part are overlapped when viewed from a direction in which said paper is carried.

6. An ink-jet printer according to claim 1, further comprising:

a ringed member for supporting the unprinted face of said paper so that a side of said paper extends toward said head is provided on a shaft supporting said carrier rollers in a position such that a part of said carrier rollers is overlapped with said supporting part when viewed from a direction in which said paper is carried.

7. An ink-jet printer according to claim 1, wherein said supporting part is positioned between said carrier rollers and said head in a vertical direction.

* * * * *